US006554749B2

(12) United States Patent
Iund et al.

(10) Patent No.: US 6,554,749 B2
(45) Date of Patent: Apr. 29, 2003

(54) LIGHTWEIGHT, CLEAR-PATH, EQUILIBRATED TREADMILL

(75) Inventors: Neal Alexander Iund, Centerville, UT (US); Kary Dell Richardson, Riverton, UT (US); Ray Alan Seamons, Millville, UT (US)

(73) Assignee: Pate Pierce & Baird, P.C., Salt Lake City, UT (US)

( * ) Notice: Subject to any disclaimer, the term of this patent is extended or adjusted under 35 U.S.C. 154(b) by 0 days.

(21) Appl. No.: 09/778,419

(22) Filed: Feb. 7, 2001

(65) Prior Publication Data

US 2001/0051564 A1 Dec. 13, 2001

Related U.S. Application Data

(60) Provisional application No. 60/181,315, filed on Feb. 9, 2000.

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 3,689,066 A * 9/1972 Hagen ..... 482/54
4,423,864 A * 1/1984 Wiik ..... 434/253
5,234,392 A * 8/1993 Clark ..... 482/54
5,993,358 A * 11/1999 Gureghian et al. ..... 482/54
6,042,514 A * 3/2000 Abelbeck ..... 482/54
6,068,579 A * 5/2000 Killian et al. ..... 482/54
6,071,354 A * 6/2000 Williams ..... 482/54
6,123,646 A * 9/2000 Colassi ..... 482/54

* cited by examiner

*Primary Examiner*—Glenn E. Richman
(74) *Attorney, Agent, or Firm*—Pate Pierce & Baird

(57) ABSTRACT

A treadmill comprising a frame for supporting the treadmill on a supporting surface, a deck, secured to the frame to be supported thereby, the deck having a front, a rear, a right and left side, and a tread surface extending from proximate the front to proximate the rear for supporting the weight of a user thereabove. A first roller, may be connected proximate the front of the deck to rotate with respect to the deck, a second roller, may be connected proximate the rear of the deck to rotate with respect to the deck. A belt may be connected to pass continuously over the tread surface and around the first and second rollers, to provide a fully exposed top surface, for unobstructed walking thereon by a user. A motor may be configured to drive the belt, the motor being positioned laterally between the right and left sides of the deck, and below the deck at a location longitudinally between the first and second rollers.

27 Claims, 6 Drawing Sheets

LIGHTWEIGHT, CLEAR-PATH, EQUILIBRATED TREADMILL

RELATED APPLICATIONS

This application is a continuation of a United States Provisional Patent Application, Serial No. 60/181, 315, filed on Feb. 9, 2000 and directed to a Lightweight, Clear-Path, Equilibrated Treadmill.

BACKGROUND

1. The Field of the Invention

This invention relates to exercise equipment and, more particularly, to novel systems and methods for configuring, driving and adjusting treadmills.

2. The Background

In an effort to generally improve one's health, many people regularly exercise. Some may be motivated by a desire to lose excess weight, while others may be motivated to exercise so that they feel invigorated and have the energy they need to better perform daily activities. Still, others may exercise to combat the effects of a physical ailments such as heart disease or diabetes.

Many methods of exercising exist. Fitness centers have been developed to provide a location where paying members may use a variety of exercise equipment and participate in aerobic classes. These fitness centers, however, are typically expensive and involve travel time. As appreciated by those who exercise, it is possible to walk, run, cycle, or the like outdoors. However, outdoor activities are often limited by the weather. In many locations, winter conditions make outdoor exercise unpleasant. Furthermore, outdoor exercise can prove to be a safety hazard for persons exercising alone.

Indoor treadmills have proven to be an effective and popular choice of exercise equipment. An indoor treadmill allows a user to exercise in the privacy of his/her home or apartment. Therefore, a user is no longer limited by the weather or the time of day. The treadmill can provide exercise across a variable range of difficulty. A user may adjust the incline of the treadmill to simply walk on a horizontal plane or run at a demanding pace on an incline. These advantages have made treadmills very popular.

Treadmills are not, however, without their limitations. Treadmills typically occupy a relatively large amount of space, when compared to other pieces of personal exercise equipment. It is not typically desirable, aesthetically or volumetrically, to leave a treadmill in the public areas of a house or apartment. Due to space limitations, the open public areas of a house or apartment are typically the only spaces large enough to accommodate typical treadmills.

Treadmills currently available are heavy, bulky, hard to store, difficult to hide, difficult to transport, and must be professionally delivered adding significant cost and greatly restricting usage. The need exists for a compact, lightweight, stable, easily shipped, easily deployable, easily storable, high quality, home treadmill. Such a treadmill would provide all the benefits of traditional treadmills, while eliminating many of the disadvantages and drawbacks of traditional treadmills.

BRIEF SUMMARY AND OBJECTS OF THE INVENTION

In view of the foregoing, it is a primary object of the present invention to provide a treadmill that has a small footprint, is readily deployable, is readily and easily storable, and operates smoothly.

It is an object of the invention to provide a treadmill designed specifically to allow the efficient use of the power source.

It is an object of the invention to provide a home exercise treadmill that uses up to date composite materials to eliminate labor, weight, and cost.

Consistent with the foregoing objects, and in accordance with the invention as embodied and broadly described herein, an apparatus and method are disclosed, in suitable detail to enable one of ordinary skill in the art to make and use the invention.

In certain embodiments an apparatus and method in accordance with the present invention may include a treadmill constructed of composite materials. Constructing the treadmill of composite materials may eliminate over 80% of the metal and weldments of the traditional treadmill. A composite deck may be pivotably connected to a frame. The rigidity of the deck may be designed to meet the treadmill's strength requirements. Additionally, all nuts may be cast into the composite deck, making the frame, rollers, and motor easily attachable to these mounting points.

The deck may be configured to have a smooth, flat tread surface with rollers attached to the front and rear extremes. Moreover, the deck may be further configured with aesthetic skirting to hide the under workings of the treadmill. The deck may be formed in a contiguously molded unit by reaction injection molding (RIM) or rotational molding (Rotomold) processes. The use of composite materials may result in a dramatic reduction in labor, manufacturing machinery, product weight, and production and shipping costs.

In certain embodiments, a third roller may be incorporated on the bottom of the deck. A belt may be configured to encircle the deck from front to back, encompassing the front roller, the rear roller, and the third roller. The third roller may be configured to provide sufficient space inside the area encircled by the belt for a motor to fit. By configuring the motor to fit inside the area encircled by the belt, the treadmill may be produced with a compact design as well as allow for the belt to be driven by the rear roller. In another embodiment, the motor is configured to secure to the deck at a location outside the area encircled by the belt while still allowing for a rear drive.

The rear drive requires approximately one third less horsepower and torque than a comparable front drive unit. The reduction is caused by the motor pulling the belt from a location much closer to the point at which the load is applied. With the motor secured to the treadmill at a location substantially below the deck, the treadmill may be configured to be hood-less, exposing the entire top belt surface. Current treadmills often use hoods to cover the motor and other drive mechanisms that extend beyond the deck surface. The hood-less design provides for an overall treadmill length approximately eight inches shorter than current treadmills, while providing the same amount of exposed usable belt.

Proximate the third bottom roller may be a fulcrum. From the fulcrum forward, the front of the deck may be raised, thus, tilting the tread surface to an incline. The fulcrum may be further configured to allow the front of the deck to be positioned lower than the rear of the deck, thus tilting the tread surface to a decline. The center pivot incline system requires approximately one third less travel to produce the same incline found on typical designs that pivot from the rear. The positioning of this lower pivot creates a balanced or equilibrated deck. A lift mechanism may be mounted between the frame and the front end of the deck. The lift mechanism regulates the incline and firmness of the deck. In certain embodiments, the lift mechanism may be a pair of hydraulic cylinders fed by a small hydraulic pump. The center pivot and resulting balanced deck greatly reduce the load that must be resolved by the lift mechanism, thus, simplifying the necessary mechanical design and associated costs.

In certain embodiments, an air bearing may float the belt over the tread surface by forcing air through numerous ports that run the length of the tread surface. The air ports may be concentrated in the center of the tread surface rather than at the outer edges. The central concentration of air ports allows the center of the belt to float and the edges to seal, producing maximum lift on the belt and resulting in the belt riding over a cushion of air. The cushion of air cleans the belt and deck surfaces, which in turn minimizes belt and deck wear. The air may also cool the belt, thus, minimizing belt stretch.

In the space created by the third roller, a plenum may be attached to the bottom of the deck. The plenum may be configured to enclose the area directly below the air ports in the tread surface. A small fan may be installed in the plenum wall to pull air into the enclosed cavity. The resulting pressure forces air through the ports in the tread surface and lifts the belt. To balance the air pressure under the belt, the plenum may be tapered toward the front of the deck.

An upright may be configured to extend upward from the frame under the treadmill and may support a console and stabilizers. The upright and stabilizers may be configured to be adjustable. The upright may be positioned at a variety of angles from substantially upright to substantially down. In the down position, the upright lays flat approximately parallel to the deck. The upright may also be configured to be removable for transport and storage. The adjustability of the upright also makes the treadmill easy to ship, store, move, and hide. The upright may be configured to have a locking system. The locking system typically maintains the upright in a selected position.

A light may be configured to emit a beam onto the surface of the belt. A shutter moving across the beam may be configured to produce on/off fluctuations. The light may be synchronized to the motor speed and may be used as a pacing mechanism by the user.

The treadmill may be further configured to have a small proximity sensor mounted to the upright. The proximity sensor may emit a beam, which, when interrupted, activates the motor. The sensor may be configured such that a user in close proximity to the sensor and between two and four feet above the deck interrupts the beam. Accordingly, when the beam is not interrupted, the drive is deactivated. If a user leaves the tread surface, the sensor will stop the belt, thus providing a safety mechanism.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 13, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
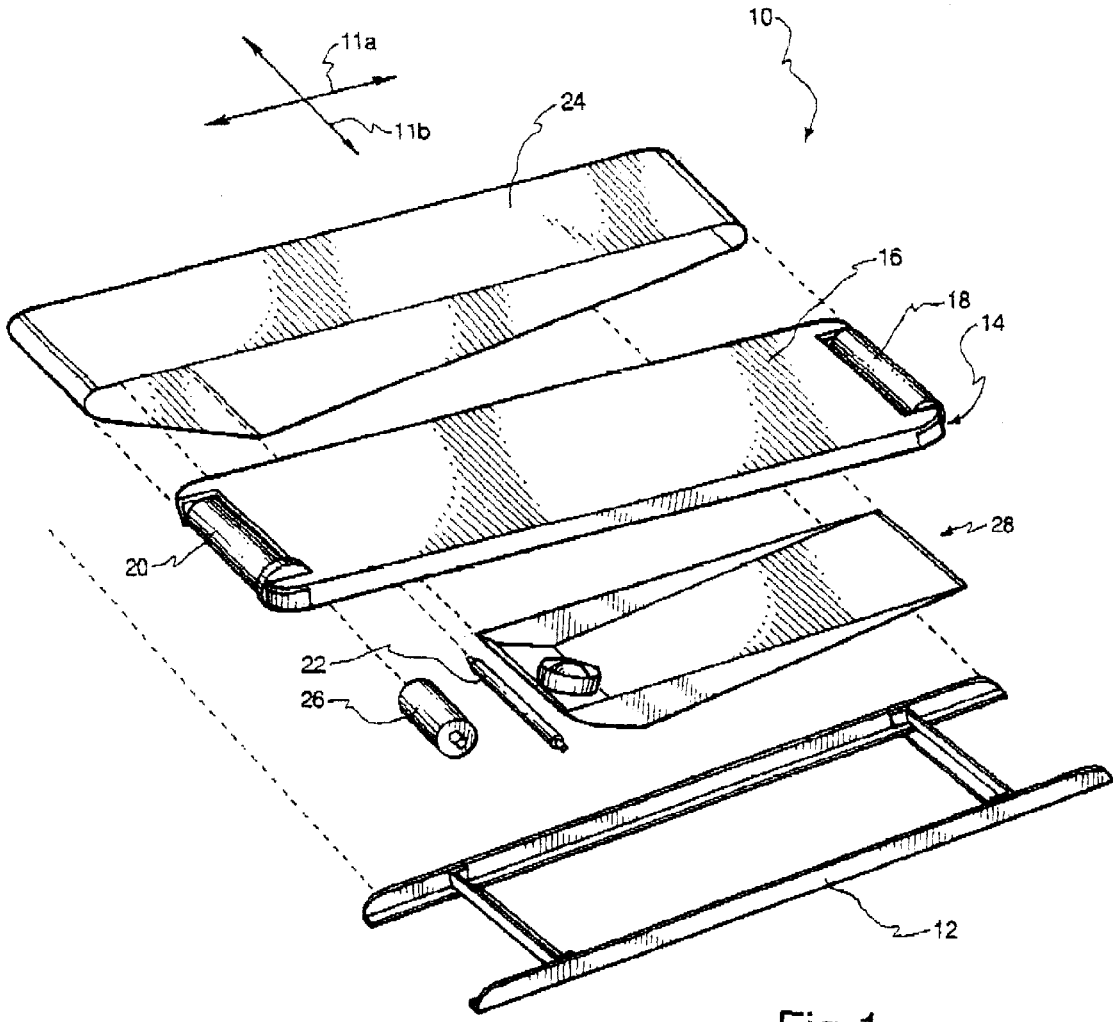
FIG. 1 is a perspective, exploded view of the treadmill.

Referring to FIG. 1, the treadmill 10 of the present invention may be supported and stabilized by a frame 12. A deck 14 may be pivotably secured to the frame 12. The deck 14 is configured to have a front and a rear end defining a longitudinal direction 11*a* and a right side and left side defining a lateral direction 11*b*. The longitudinal direction 11*a* and the lateral direction 11*b* are substantially orthogonal to one another.

A tread surface 16 extends from proximate a front roller 18 to proximate a rear roller 20. The tread surface 16 is configured to support the weight of a user thereabove. The front and rear rollers 18, 20 are capable of rotation with respect to the deck. A third roller 22 may be connected to the deck 14 below the tread surface 16 at a location spaced longitudinally 11 a between the front and rear rollers 18, 20. A continuous belt 24 encircles the deck 14 being substantially supported by the front roller 18, the rear roller 20 and the third roller 22. A motor 26 is configured to drive the belt 24. The motor 26 may be positioned longitudinally between the front and rear rollers 18, 20. An air bearing mechanism 28 distributes pressurized air between the tread surface 16 and the belt 24 for supporting the belt 24 on a layer of the pressurized air.

Figure 2:
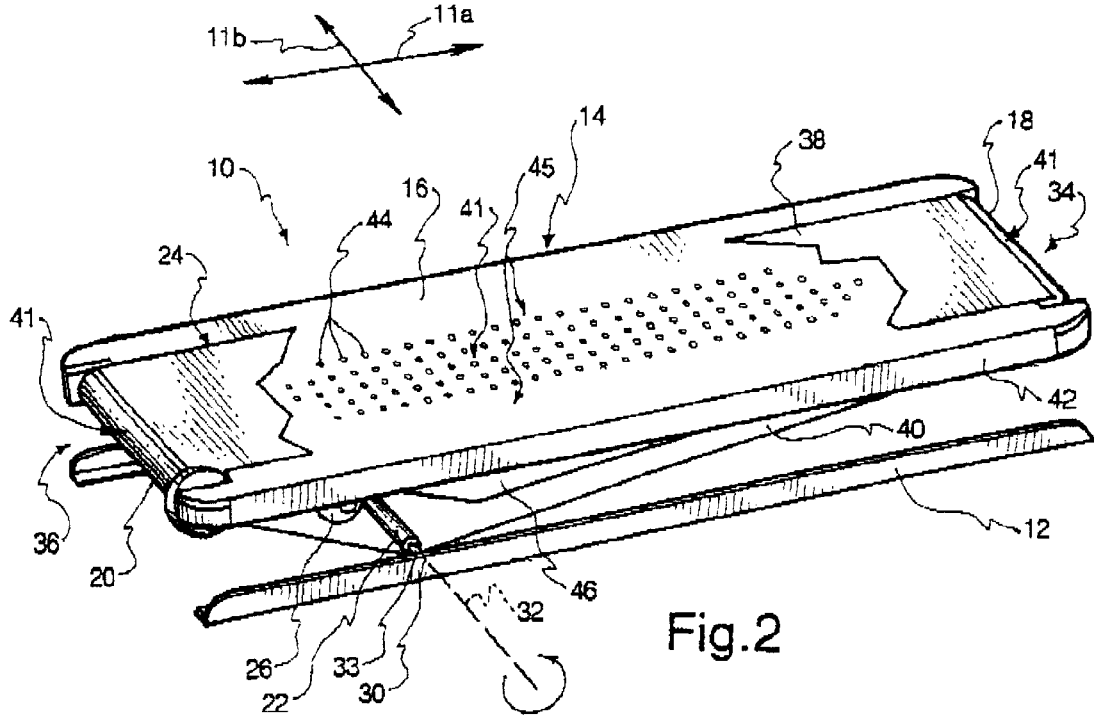
FIG. 2 is a top perspective view of the treadmill with portions of the belt and side skirting removed in order to expose the deck surface, as well as the inner workings of the treadmill.
Figure 3:
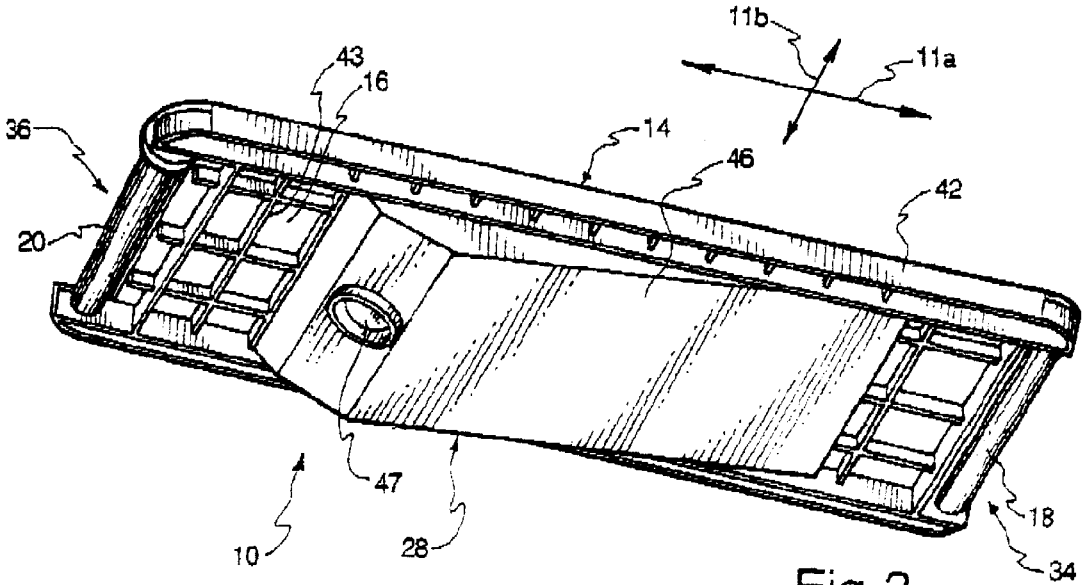
FIG. 3 is a bottom perspective view of the treadmill with the belt and side skirting removed in order to expose the structure of the deck and plenum.

Referring to FIGS. 2 and 3, the deck 14 is pivotably connected to the frame 12 at a fulcrum 30. The fulcrum 30 defines an axis of rotation 32 of the deck 14 with respect to the frame 12. The axis of rotation 32 may be defined by an axle 33 of the third roller 22. In another embodiment (not shown) the axis of rotation 32 may be located below the third roller 22. The axis of rotation 32 need not be directly below the third roller 22, but may be located proximate the third roller 22 toward a front end 34 of the treadmill 10 or proximate the third roller 22 toward a rear end 36 of the treadmill 10.

The third roller 22 and fulcrum 30 may be positioned at any convenient longitudinal 11*a* location between the front end 34 and the rear end 36 of the treadmill 10. The position of the fulcrum 30 may be determined by achieving a desirable balance between the weight of the front and rear portions 34, 36 of the deck 14. Furthermore, the spacing between the fulcrum 30 and the tread surface 16 may be varied to accommodate maximum desired angle of incline or decline for the deck 14. That is, by increasing the distance between the fulcrum 30 and the tread surface 16, the deck 14 may be inclined or declined to a steeper angle.

The belt 24 has a top belt surface 38, which longitudinally covers the tread surface 16 and a bottom belt surface 40 passing below the deck 14 to form a continuous loop. The belt 24 may be constructed of any material that provides the necessary strength, durability, resistance to stretch, and frictional characteristics.

The front, rear, and third rollers 18, 20, 22, may be configured to support and tension the belt 24. The front and rear rollers 18, 20 may also be configured to ensure proper tracking of the belt 24. Tracking may be accomplished by providing a shoulder or other stop mechanism (not shown) on the rollers 18 and 20 to prevent migration of the belt 24 past a particular location on the rollers 18, 20. Another embodiment may include a roller 18, 20 having a diameter that decreases toward a lateral 11*b* center 41 of the deck 14. Such a decreasing diameter promotes migration of the belt 24 to the desired center location 41.

The front and rear rollers 18, 20 may be constructed of plastic, a variety of polymers, rubber, metal, a variety of metal alloys, a variety of composites, or any material that provides the necessary wear resistance and sufficient static coefficient of fiction with respect to the belt 24 to prevent unwanted slip between the belt 24 and rollers 18, 20. The static coefficient of fiction with respect to the belt 24 may be a characteristic of the roller 18, 20 material itself or the result of an applied finish. Additionally, the rollers 18, 20 may be modified to provide a rough surface (not shown) to promote gripping of the belt 24.

In another embodiment, the front and rear rollers 18, 20 may be configured to act as momentum fly wheels. Such a configuration may be accomplished by increasing the rotational inertia of the rollers 18, 20 to resist sudden changes in belt 24 speed. Such a configuration tends to relieve the pulsating loads of each user foot step that is typically overcome by the motor 26.

The deck 14 may be constructed of a variety of woods, plastics, polymers, reinforced polymers, composites, metals, metal alloys, or any material that exhibits the necessary rigidity, strength, and wear resistance. The deck 14 may be formed of a tread surface 16 supported by rails (not shown) attached thereto. The tread surface 16 may have a skirting 42 attached thereto. The skirting 42 may provide additional rigidity and also improve the aesthetic appeal of the treadmill 10 by extending downward (not shown) to cover and hide the underside of the deck 14.

In another embodiment, the tread surface 16 may be formed or molded to provide the necessary rigidity and strength, thus eliminating the need for the addition of strengthening rails. Such rigidity may be provided by a rib structure 43 molded to support the tread surface 16. The ribs 43 may be configured to run longitudinally 11*a,* laterally 11*b,* or any combination of longitudinal 11*a* and lateral 11*b* directions. Furthermore, the ribs 43 may be configured to run angularly with respect to each other and/or with respect to the aesthetic skirting 42 of the deck 14.

The spacing between laterally 11*b* and longitudinally 11*a* extending ribs 43 may be selected to provide the necessary strength to support a user exercising on the tread surface 16. The thickness and height of the ribs 43 may also be varied to control and the rigidity and strength of the tread surface 16.

In certain embodiments, the ribs 43 form a mesh, which may be attached to the underside of the tread surface 16 to provide the strength that is necessary to support the user. Such a construction would allow the tread surface 16 and ribs structure 43 to be constructed of different materials selected to provided optimum performance for their given purposes. The ribs 43 may be configured for optimum strength, while the tread surface 16 material may be selected to have a low friction with respect to the belt 24.

In one presently preferred embodiment, the deck 14 is a contiguously molded unit formed of any suitable material. The material may also be selected from the group consisting of a homogeneous polymeric composition, a structurally reinforced polymeric composition, and a substantially homogeneous polymeric composition containing structurally reinforcing fibers distributed substantially evenly therethrough. The contiguously molded deck 14 may be configured to contain the tread surface 16, the skirting 42, and the ribbing 43 to produce a sufficiently strong and rigid single piece deck 14.

The deck 14 may be further configured to have air ports 44. The air ports 44 may be distributed in a manner promoting the efficient insertion of air between the tread surface 16 and the top belt surface 38. The ports 44 may be sized to deliver larger amounts of air to selected locations than other selected locations to improve the lift produced on the top belt surface 38. In one embodiment, the air ports 44 are concentrated along the lateral 11*b* center 41 of the tread surface 16 and sized to provide the largest air insertion at the lateral 11*b* center 41 of the deck with decreasing delivery of air at the lateral 11*b* extremes 45.

Air may be introduced to the air ports 44 by any suitable air transport. In one presently preferred embodiment, the air is delivered to the ports 44 by a plenum 46. The plenum 46 secures to the underside of the tread surface 16, directly below the air ports 44. The plenum 46 may be molded of a polymer or formed of sheet metal or any other suitable material. The plenum 46 encloses the underside of the air ports 44 and forms a sealed cavity with the only exit being the air ports 44. Air may be introduced into the plenum 46 by a fan 47 located in the plenum 46 wall. The fan 47 forces air into the plenum 46. The pressurized plenum 46 delivers air at uniform pressure to the air ports 44 for subsequent insertion under the top belt surface 38. The top belt surface 38 is lifted off the tread surface 16, resulting in reduced frictional forces therebetween.

Figure 4:
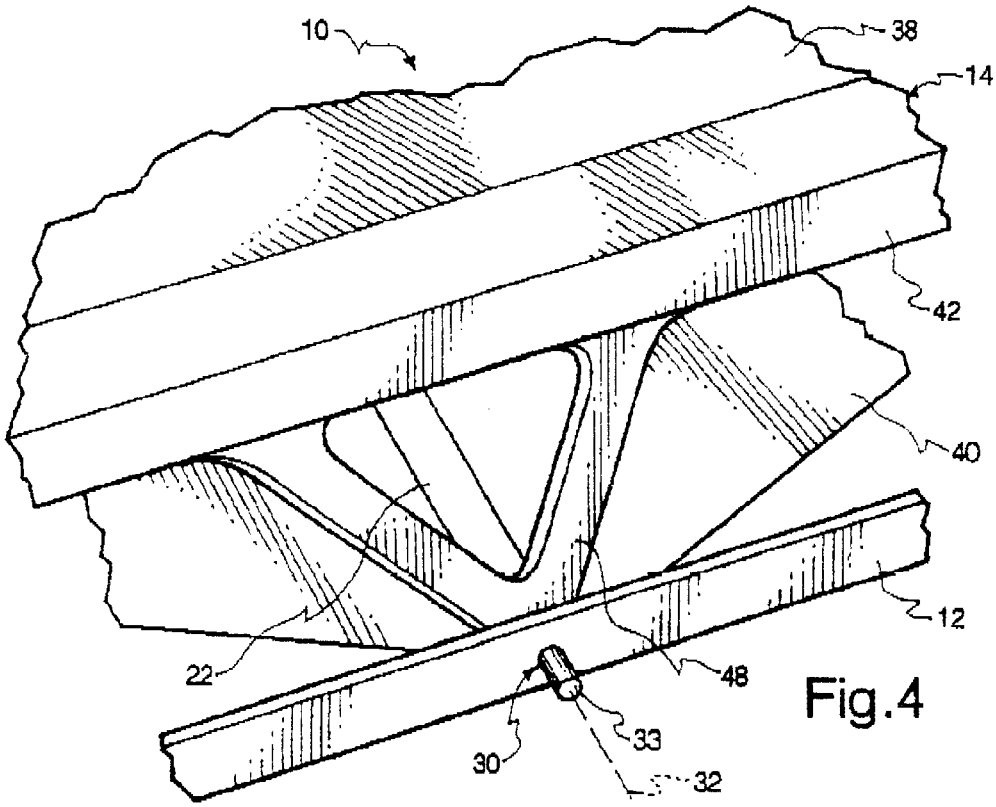
FIG. 4 is close-up, perspective view of the treadmill fulcrum area illustrating a simple support of the third roller, the third roller axle forming the fulcrum and axis of rotation.

Referring to FIG. 4, the third roller 22 spaces the bottom belt surface 40 away from the deck 14. In actuality, the third roller 22 need not be a roller or rotatable at all. Any mechanical extension (not shown) that holds the bottom belt surface 40 away from the deck 14 and allows the bottom belt surface 40 to easily slide with respect thereto, is sufficient. All devices and mechanical extensions that maintain spacing between the bottom belt surface 40 and the deck 14 will be hereafter referred to as a third roller 22. The third roller 22 provides the space under the tread surface 16 that is necessary to accommodate the motor 26, if desired, and plenum 46.

In an alternate embodiment, the third roller 22 may be omitted. As discussed hereinabove, the third roller 22 provides spacing between the bottom belt surface 40 and the deck 14. If no need exists for spacing, the third roller 22 may be omitted. Such a situation might be occasioned by a reduction in the size of the plenum 46 or by the securing of the motor 26 at a location outside the area encircled by the belt 24.

The third roller 22 may be supported away from the deck 14 by any suitable support structure 48. The support structure 48 may extend from the deck 14 and be secured to the third roller axle 33. The support 48 may be constructed of any material having the required characteristics, such as strength and rigidity. Additionally, FIG. 4 illustrates an embodiment of the third roller axle 33 providing the fulcrum 30 between the frame 12 and the deck 14, as discussed hereinabove.

Figure 5:
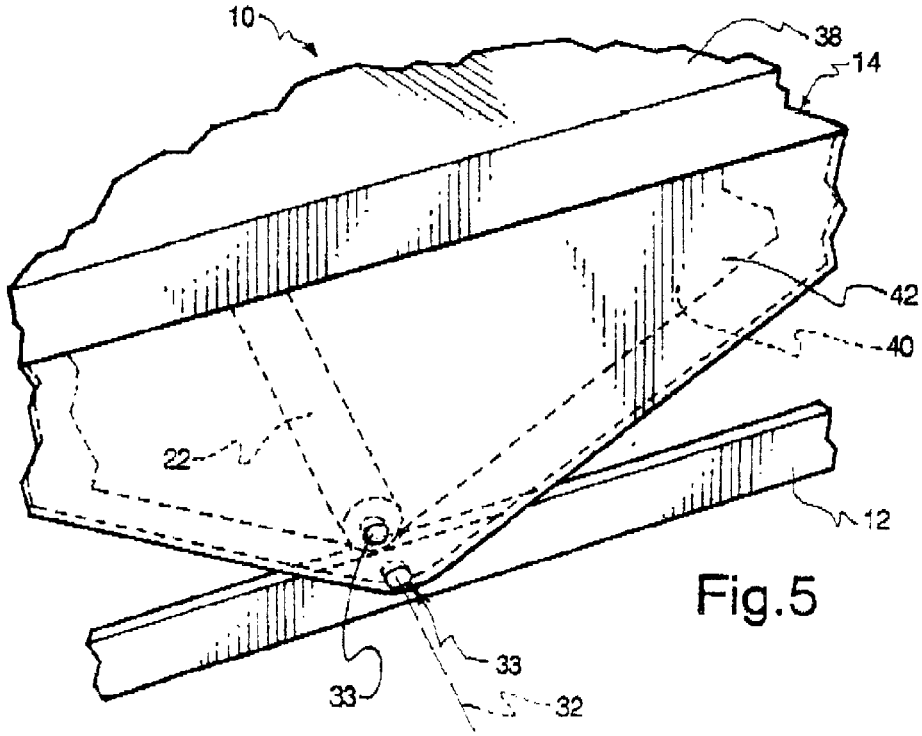
FIG. 5 is a close-up, perspective view of the treadmill fulcrum area illustrating one embodiment wherein the deck skirting provides the structure to support the third roller and the fulcrum.

Referring to FIG. 5, the support for the third roller 22 may be provided by the skirting 42. FIG. 5 illustrates an embodiment wherein the skirting 42 extends downward to provide a location to secure the third roller axle 33. Furthermore, the skirting 42 may be configured to provide the structure required to support the deck 14 on the fulcrum 30. As discussed hereinbove, the fulcrum 30 may be positioned proximate, or below as illustrated, the third roller 22.

The embodiment of FIG. 5, does not include aesthetic skirting 42 with support structure on the inner surface (toward bottom belt surface 40). Ribs 43, similar to those discussed hereinabove, may be added to the inner surface of the aesthetic skirting 42 to increase the rigidity, strength, and durability. In this way, the aesthetic skirting 42 may be strengthened and stiffened sufficient to support the weight of a user exercising on the treadmill 10.

Figure 6:
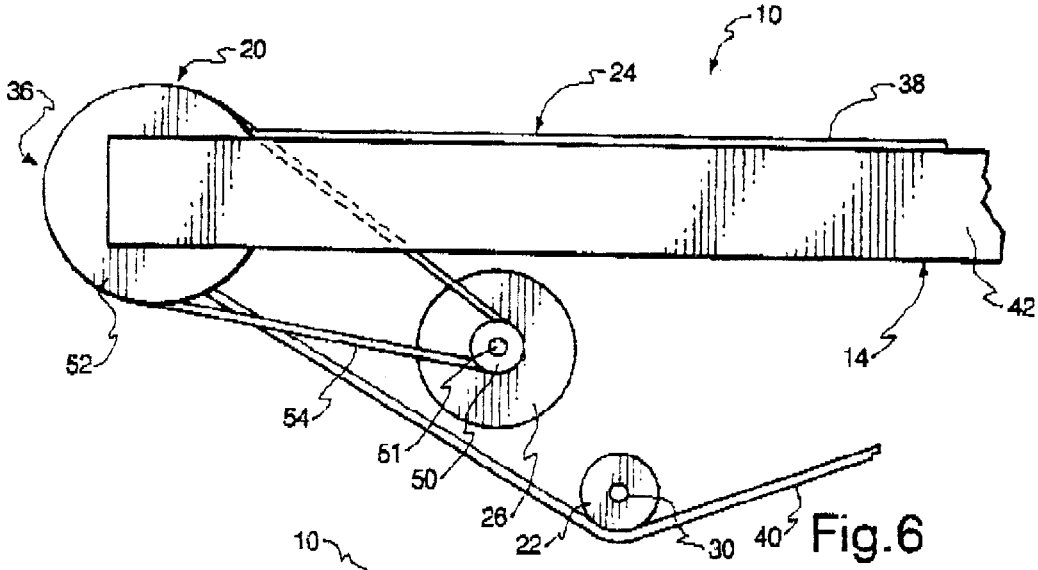
FIG. 6 is close-up, side view of one embodiment of a drive mechanism.

Referring to FIG. 6, the motor 26 may be configured to drive the belt 24. In one presently preferred embodiment, the motor 26 is configured to rotate the rear roller 20, which provides a more efficient drive mechanism than treadmills having a front drive system. The motor 26 may be secured to the deck 14 on the rear side 36 of the fulcrum 30. In such a configuration, the weight of the motor 26, one of the heaviest components on the treadmill 10, will tend to counteract the weight of the front end 34 of the treadmill 10. The motor 26 may be configured to impart motion to the rear roller 20 by any suitable drive mechanism. Such drive mechanisms may include with limitation gears, chain belts, v-belts, shaft drive, or the like.

One presently preferred embodiment, transfers rotation from a pulley 50 secured to a motor shaft 51 to a pulley 52 rigidly secured to the rear roller 20 by a timing belt 54. The pulleys 50, 52 may be sized to provide optimum speed and power in rotating the belt 24. If desired, the motor shaft 51 may be further configured to rotate a fly wheel (not shown). The fly wheel may be configured to have a large rotational inertia, which would resist sudden changes in belt 24 speed. Such a configuration may relieve the pulsating loads of each user foot step that is typically overcome by a motor 26.

Figure 7:
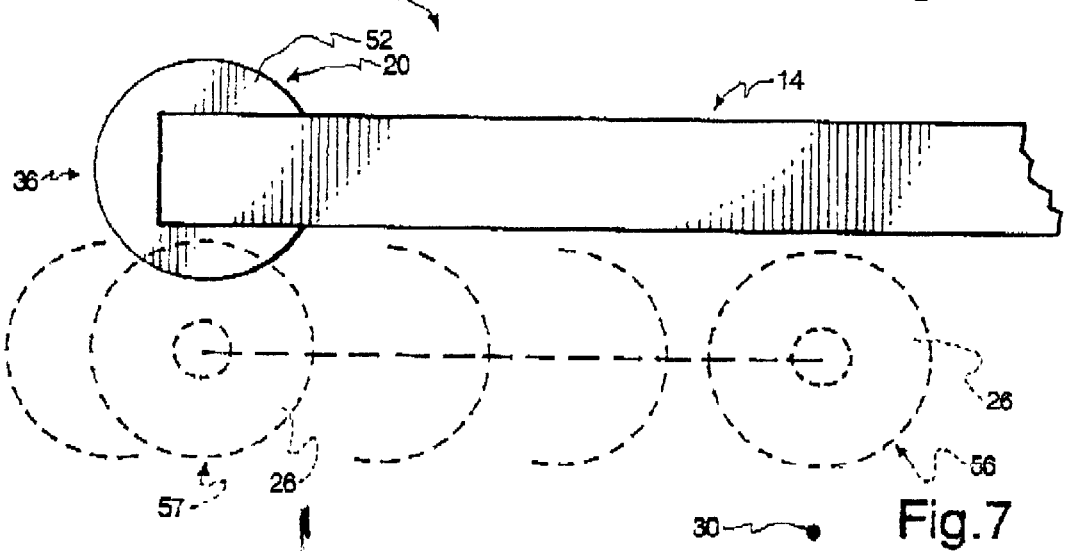
FIG. 7 is close-up, side view of a plurality of locations where the motor may be configured to secure to the deck.

FIG. 7 illustrates other possible locations of the motor 26 in relation to the deck 14. The motor 26 may be secured at a location 56 substantially above the fulcrum 30. The motor 26 may also be configured to be secured at a location 57 substantially below or slightly behind the rear roller 20. The motor 26 may further be configured to be secured to the deck 14 at a plurality of locations between location 56 and location 57. In order to accommodate the several possible motor locations, the motor 26 may be configured for securement to the deck 14 from a location inside or outside the area encircled by the belt 24.

Figure 8:
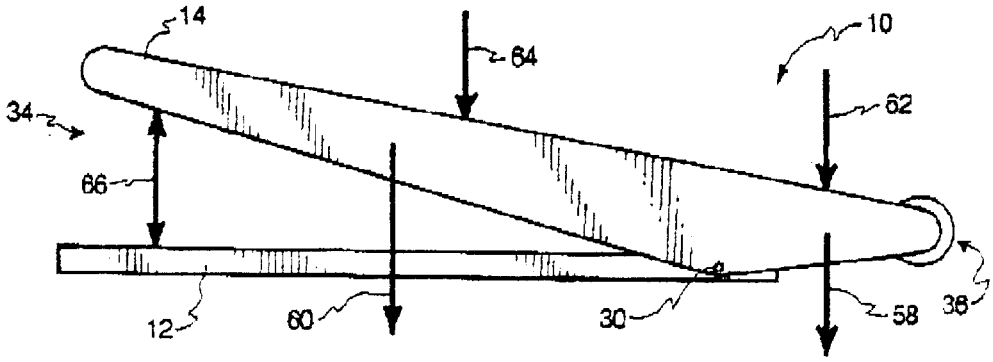
FIG. 8 is a free body diagram of the treadmill with all relevant forces represented as vectors.

FIG. 8 is a free body diagram of the deck 14 rotatable about the fulcrum 30. The weight of the rear portion 58 comprises the weight of the rear end 36 of the deck 14 including the motor 26 enclosed inside the enclosure. The weight of the front portion 60 comprises the weight of the front end 34 of the deck 14. A foot of a user (not shown) applies a force 62 to the rear portion 36 of the deck 14. The other foot of the user (not shown) applies a force 64 to the front portion 34 of the deck 14. A lift mechanism (not shown) may impart a positive or negative force 66 on the front portion 34 of the deck 14.

The present invention provides a method for incline adjustment that minimizes the force 66 that must be applied by a lift mechanism (not shown) to change the incline of the deck 14 with respect to the frame 12. The fulcrum 30 located substantially between the front 34 and rear 36 ends of the deck 14 allows the user to apply at least a portion of the user's weight 62 behind the fulcrum 30, thus, aiding in lifting the front portion 34. In fact, by adjusting the weight applied on the front 64 and rear 62 portions of the deck 14, the user may be able to lift the front portion 34 without the aid of the lifting mechanism 66. By greatly reducing the lifting force 66 required to lift the front portion 34 of the deck 14, the lifting mechanism itself may be greatly simplified in design and capacity as compared to traditional treadmills, thus reducing weight and cost.

Figure 9:
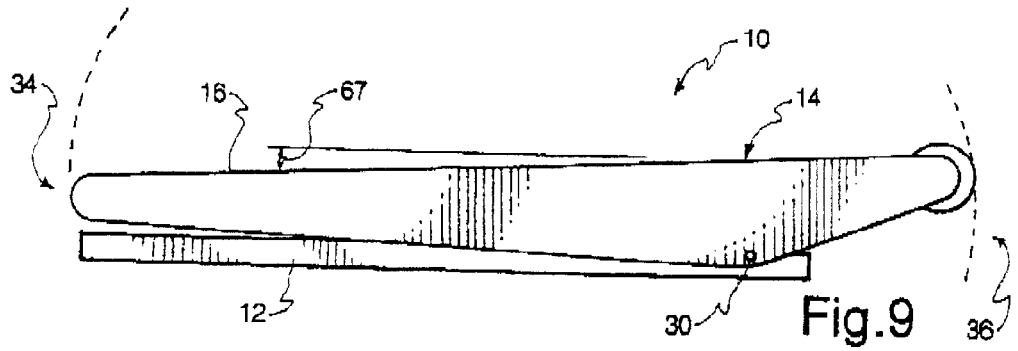
FIG. 9 is a side view of the treadmill with the deck positioned at a decline.

Referring to FIG. 9, the deck 14 is shown at a decline. In one presently preferred embodiment, the fulcrum 30 may be configured to allow the front end 34 of the deck 14 to be positioned below the rear end 36 of the deck 14, thus, producing an angle of descent 67. The angle of descent 67 allows the user to simulate walking, jogging, or running downhill. Downhill exercise uses a different muscle group of the user than does uphill exercise. In order to obtain a well rounded workout, it is advantageous to have a treadmill that is able to provide a declining, level, and inclined tread surface 16.

As discussed hereinabove, the distance between the fulcrum 30 and the tread surface 16 may be increased to provide for an increased angle of decline 67. The greater the distance between the fulcrum 30 and tread surface 16, the more the front portion 34 of the deck 14 may lower with respect to the rear portion 36 of the deck 14.

Figure 10:
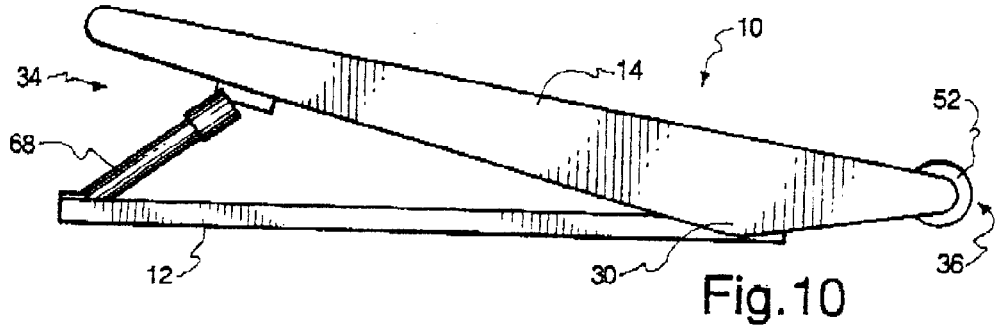
FIG. 10 is a side view of the treadmill with the lift mechanism embodied as a hydraulic cylinder and with the deck at an incline.

Referring to FIG. 10, the deck 14 is shown at an incline with respect to the frame 12. The incline may be provided and held by a lift cylinder 68 or by a pair of lift cylinders 68. The lift cylinder 68 may be any hydraulic system. The working fluid may be any suitable fluid such as air or an oil. In one embodiment, the lift cylinder 68 may be driven by a small hydraulic pump (not shown) that provides a lifting force 66. The amount of force 66 that must be generated by the lift cylinder 68 can be controlled by the user as discussed hereinabove. Furthermore, the incline produced by the lift cylinder 68 may be remotely controlled by a user while exercising on the treadmill 10.

In another embodiment, the lift cylinder 68 provides no force. The user controls the incline and the lift cylinder 68 functions as a damper to provide smooth adjustment from one incline to another. The lift cylinder 68 may further be configured to contain a valve, such as a check valve (not shown), which restricts flow in and out of the lift cylinder 68, thus providing a lock for maintaining the deck 14 at a desired incline. The valve may be actuated by a user while operating the treadmill 10. The modulus of the entrapped hydraulic fluid can provide a spring to cushion the foot impacts of the user on the deck 14. The selection of the hydraulic fluid determines the spring constant of the spring.

Figure 11:
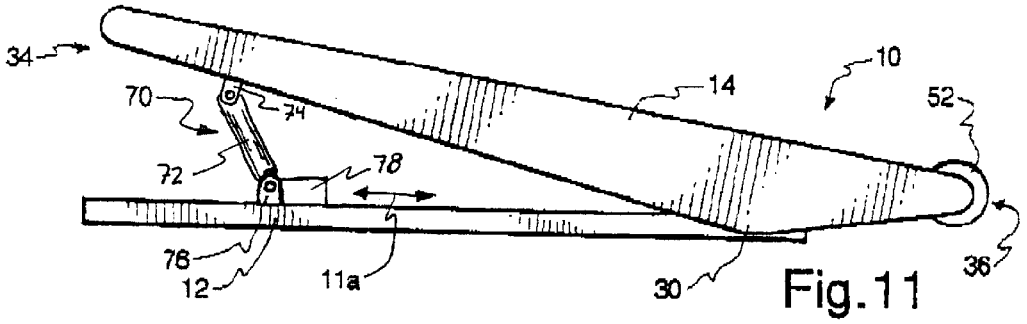
FIG. 11 is a side view of the treadmill with the lift mechanism embodied as a two force member and with the deck at an incline.

FIG. 11 illustrates another alternative embodiment for an incline adjuster 70. The incline adjuster 70 may be configured to have a two force member 72 mounted between a pivot 74 secured to the deck 14 and a frame pivot 76. In this embodiment, the pivot 76 is configured to slide along a length of the of the frame 12 in a longitudinal direction 11*a*. The lift mechanism 70 slides along the frame 12 in response to the weighting applied by a user, as discussed hereinabove. When the desired incline has been achieved, the user may remotely activate a lock 78, which secures the pivot 76 to the desired location along the frame 12. When a new incline is desired by a user, the lock 78 may be released and locked again at the new incline.

Figure 12:
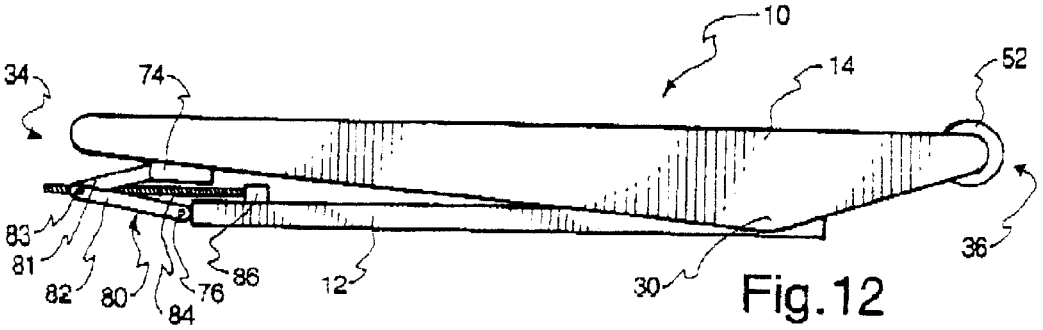
FIG. 12 is a side view of the treadmill with the lift mechanism embodied as a scissor hinge and with the deck in a horizontal position.

FIG. 12 illustrates an embodiment of a scissor lift mechanism 80. One end of an upper scissor leg 81 is pivotably connected to one end of a lower scissor leg 82 at a scissor pivot 83. The opposite end of scissor leg 81 is pivotably connected to the deck pivot 74 and the opposite end of lower scissor leg 82 is pivotably connected to the frame pivot 76. A drive screw 84 attaches to the scissor lift 80 at the scissor pivot 83. The opposite end of the drive screw 84 is attached to a drive 86. The drive 86 is pivotably connected to the frame 12 and is configured to rotate the drive screw 84. The rotation of the drive screw 84 pulls the scissor pivot 83 toward the drive 86, thus elevating the deck front 34. The scissor lift 80 may be configured to lock the deck 14 at a desired incline.

In another embodiment of the present invention, a reverse scissor lift (not shown) may be employed to modify the incline of the deck 14. In a reverse scissor mechanism, the scissor pivot 83 may be located on the drive 86 side of the pivots 74, 76. Rotation of the drive screw 84 would then increase the distance between the drive 86 and the scissor pivot 83 thus extending the pivot legs 81, 82 and modifying the incline of the deck 14.

Additionally, the scissor lift mechanism 80 may be configured for manual adjustment. In this embodiment, the scissor lift mechanism 80 may be rotated 180 degrees so that the drive 86 extends toward the front 34 of the treadmill 10. In such a configuration, the drive 86 may comprise a hand crank (not shown) accessible from the front 34 of the treadmill 10.

The present invention may be embodied with other lift mechanisms and incline adjusters without departing from its structures, methods, or other essential characteristics as broadly described herein. The embodiments described hereinabove are to be considered in all respects only as illustrative, and not restrictive.

Figure 13:
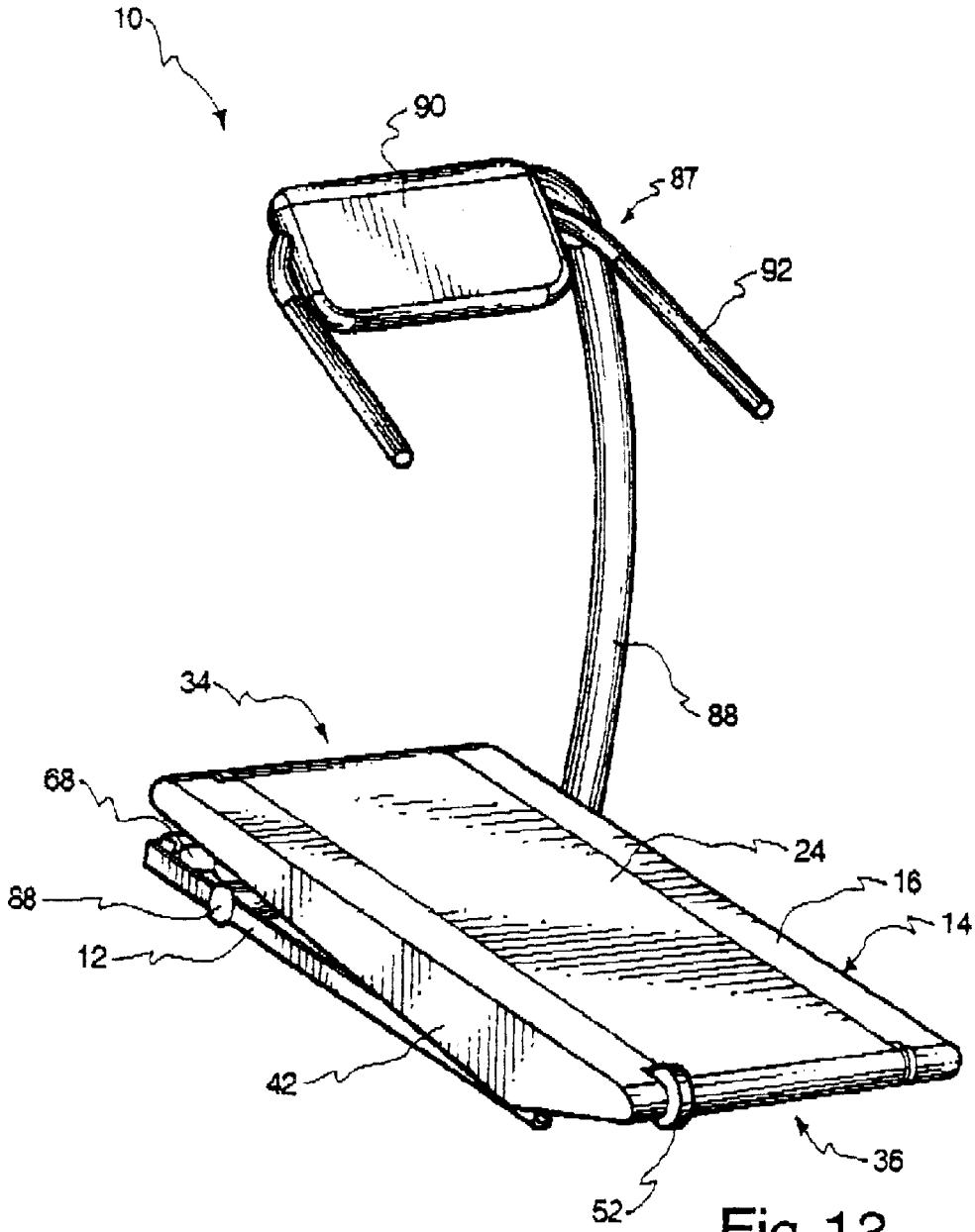
FIG. 13 is a perspective view of a presently preferred embodiment of the entire treadmill.

FIG. 13 illustrates an embodiment of the entire treadmill 10. A user registration 87 extends upward so as to be positioned in front of a user (not shown) operating the treadmill 10. The user registration 87 may be secured at its lower extreme to the deck 14 or the frame 12. The user registration provides a visual reference with which the user can gauge his/her position on the treadmill 10. The user registration 87 further provides a location for information and controls needed for efficient operation of the treadmill 10.

In one embodiment, the user registration 87 comprises an upright 88 extending upward from the frame 12. If desired, the upright 88 may be configured as a single pole extending upward on only one side of the treadmill 10. The upright 88 may additionally be configured to support a console 90.

In one embodiment the console 90 is a collection of electronic readouts and controls. The readouts and controls can provide the user with any information or control that might be convenient. Readouts might include the speed of the belt 24, distance traveled, calories burned and degree of incline of the deck 14. Controls might include speed adjustment of the belt 24, incline adjustment, incline lock activation, and the like. The upright 88 may be further configured to support one or more stabilizers 92. The stabilizers 92 provide structures for a user to grab to steady himself/herself. The stabilizers 92 may be formed to any geometry that might add to the safety or convenience of the user.

The user registration 87 may be further configured to be adjustable. The upright 88 may be positioned in a variety of positions from completely upright (as shown), to completely down, laying flat proximate the deck 14. The upright 88 may also be configured to be removable for transport and storage. The adjustability of the upright 88 and stabilizers 92 make the treadmill easy to ship, store, move, and hide. The different positions of the upright 88 and stabilizers 92 may be configured to have a locking system (not shown), thus holding the user registration 87 in a selected position.

The user registration 87 may be further configured to have a pacing mechanism (not shown) to aid a user in maintaining a desired pace. One embodiment of the pacing mechanism may comprise a light configured to emit a beam onto the surface of the belt 24. A shutter moving across the beam may be provided to produce alternating on/off illumination of a location on the belt 24. The light may be synchronized to the speed of the motor 26 and may be used as a pacing mechanism by the user.

The user registration 87 may be further configured to have a safety mechanism (not shown) configured to stop the belt 24 from rotating if the user leaves the tread surface 16. In one embodiment the safety mechanism is a tether connecting a user to the treadmill 10. If the user leaves the tread surface 16, the tether pulls a switch that stops the belt 24. In another embodiment, the safety mechanism is configured to be a proximity sensor mounted to the upright 88. The proximity sensor may emit a beam which, when interrupted, activates the motor 26. A user in close proximity to the sensor and between two and four feet above the tread surface 16 interrupts the beam. When the beam is not interrupted, the belt 24 is stopped. Thus, when a user leaves the tread surface 16, the sensor will not be interrupted and the belt 24 will stop.

From the above discussion, it will be appreciated that the present invention provides a treadmill having a center pivot. The center pivot provides an equilibrated deck. The motor may be configured to drive the belt from the rear, resulting in an efficient power usage. The efficient power usage may allow a relatively small motor to be used without lowering performance. Furthermore, the motor may be mounted below the tread surface, thus allowing the entire tread surface to be exposed and usable. The efficient use of all the tread surface allows the deck to be significantly shorter than current treadmills. The upright is configured to be removed or to be rotated a flat position proximate the deck. The treadmill may be constructed of composite materials producing a strong design that weighs much less than traditional treadmills. The relatively short deck, the foldable upright, and low weight of the present invention result in a treadmill that is compact, lightweight, stable, easily shipped, easily deployable, and easily stored.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A treadmill comprising:

a frame for supporting the treadmill on a supporting surface;

a deck, secured to the frame to be supported on a supporting surface thereby, the deck having a front and rear defining a longitudinal direction, a right side and left side defining a lateral direction, and a tread surface extending from proximate the front to proximate the rear for supporting the weight of a user thereabove;

a first roller, connected proximate the front of the deck to rotate with respect to the deck;

a second roller, connected proximate the rear of the deck to rotate with respect to the deck;

a belt connected to pass continuously over the tread surface and around the first and second rollers;

an air bearing mechanism comprising a fan drawing air from the ambient and a plenum to receive a supply of pressurized air from the fan and direct the pressurized air to ports positioned to distribute the pressurized air between the deck and the belt for supporting the belt on a layer of the pressurized air; and a motor connected to drive the belt.

2. The treadmill of claim 1, further comprising an incline adjustment connected intermediate the deck and the frame for selectively spacing the front of the deck above the frame.

3. The treadmill of claim 2, wherein the incline adjustment further comprises:

a lock for maintaining the spacing between the deck and the frame; and a release for selectively releasing the lock by a user.

4. The treadmill of claim 1, wherein the deck further comprises a fulcrum and is pivotably secured to the frame for selectively tilting with respect thereto about the fulcrum.

5. The treadmill of claim 4, wherein the fulcrum is positioned longitudinally away from the second roller at a location selected to equilibrate a substantial portion of the weight of the front of the deck in response to application of the weight of a user proximate the second roller.

6. The treadmill of claim 4, wherein the fulcrum is positioned longitudinally away from the second roller at a location selected to tilt the front of the deck upwardly in response to application of the weight of a user proximate the second roller.

7. The treadmill of claim 4, wherein the fulcrum is positioned longitudinally away from the second roller at a location selected to equilibrate a substantial portion of the weight of the front of the deck, forward of the fulcrum, by the weight of the rear portion of the deck, behind the fulcrum.

8. The treadmill of claim 7, wherein the motor is positioned behind the fulcrum to provide the motor weight for equilibration of the weight of the front of the deck.

9. The treadmill of claim 8, wherein the motor drives the belt by rotating the second roller.

10. The treadmill of claim 9, wherein the deck is a single, contiguously molded unit.

11. The treadmill of claim 10, wherein the contiguously molded unit is formed of a material selected from a homogeneous polymeric composition, a structurally reinforced polymeric composition, and a substantially homogeneous, polymeric composition containing structurally reinforcing fibers distributed substantially evenly therethrough.

12. The treadmill of claim 11, further comprising a third roller configured to rotatably attach to the deck below the tread surface and maintain spacing between the belt and the deck.

13. The treadmill of claim 1, wherein the deck further comprises a fulcrum and is pivotably secured to the frame for selectively tilting with respect thereto about the fulcrum.

14. The treadmill of claim 13, wherein the fulcrum is positioned longitudinally away from the second roller at a location selected to equilibrate a substantial portion of the weight of the front of the deck in response to application of the weight of a user proximate the second roller.

15. The treadmill of claim 13, wherein the fulcrum is positioned longitudinally away from the second roller at a location selected to tilt the front of the deck upwardly in response to application of the weight of a user proximate the second roller.

16. The treadmill of claim 13, wherein the fulcrum is positioned longitudinally away from the second roller at a location selected to equilibrate a substantial portion of the weight corresponding to the front of the deck, forward of the fulcrum, by the weight corresponding to the rear portion of the deck, behind the fulcrum.

17. The treadmill of claim 13, wherein the motor is positioned behind the fulcrum to provide the motor weight for equilibration of the weight of the front of the deck.

18. The treadmill of claim 1, wherein the motor is configured to drive the belt by rotating the second roller.

19. The treadmill of claim 1, wherein the deck is configured as a homogeneous unitary structure.

20. The treadmill of claim 1, further comprising a user registration structure for positioning a user on the treadmill.

21. The treadmill of claim 20, wherein the user registration structure further comprises an upright secured to the frame and configured to move between a first stowed position proximate the frame and a second deployed position away from the frame.

22. The treadmill of claim 21, wherein the upright further comprises an asymmetric structure secured to a single side of the frame.

23. The treadmill of claim 1 further comprising a pacing strobe configured to periodically illuminate the belt for assisting a user in setting a consistent exercise pace.

24. The treadmill of claim 1, further comprising a non-contacting proximity sensor configured to detect the presence of a user on the treadmill and to control operation of the motor in accordance therewith.

25. The treadmill of claim 1, further comprising a third roller configured to rotatably attach to the deck below the tread surface and maintain spacing between the belt and the deck.

26. The treadmill of claim 1, wherein the deck further comprises:

a fulcrum, pivotably securing the deck to the frame;

the fulcrum configured to provide selective tilting of the deck with respect to the frame in a plurality of positions, ranging from a first position to a second position;

the first position providing the deck at a decline; and the second position providing the deck at an incline.

27. The treadmill of claim 1, wherein the motor is positioned laterally between the right and left sides of the deck, and below the deck at a location longitudinally between the first and second rollers.

* * * * *